US007882939B2

(12) United States Patent
Nakamura

(10) Patent No.: US 7,882,939 B2
(45) Date of Patent: Feb. 8, 2011

(54) ELEVATOR OPERATING APPARATUS

(75) Inventor: Kuniko Nakamura, Tokyo-To (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 740 days.

(21) Appl. No.: 11/578,139

(22) PCT Filed: Apr. 7, 2005

(86) PCT No.: PCT/JP2005/006875

§ 371 (c)(1),
(2), (4) Date: Aug. 29, 2007

(87) PCT Pub. No.: WO2005/097652

PCT Pub. Date: Oct. 20, 2005

(65) Prior Publication Data

US 2008/0128216 A1 Jun. 5, 2008

(30) Foreign Application Priority Data

Apr. 9, 2004 (JP) ..... 2004-115781

(51) Int. Cl.
*B66B 1/34* (2006.01)

(52) U.S. Cl. ..... 187/391; 187/384

(58) Field of Classification Search ..... 187/247, 187/380–388, 391–396
See application file for complete search history.

(56) References Cited

U.S. PATENT DOCUMENTS 4,590,604 A * 5/1986 Feilchenfeld ..... 704/272
5,602,963 A * 2/1997 Bissonnette et al. ..... 704/275
6,223,160 B1 * 4/2001 Kostka et al. ..... 704/275
6,868,945 B2 * 3/2005 Schuster et al. ..... 187/380
6,986,408 B2 * 1/2006 Takeuchi ..... 187/380
7,162,233 B2 * 1/2007 Chiba ..... 455/420
7,620,817 B2 * 11/2009 Friedli et al. ..... 713/182

FOREIGN PATENT DOCUMENTS

CN 1462717 A 12/2003
JP 3-83778 A 4/1991

(Continued)

OTHER PUBLICATIONS

Office Action issued Aug. 27, 2010, in Japanese Application No. 2004-115781 with English-language Translation (6 pgs).

*Primary Examiner*—Jonathan Salata
(74) *Attorney, Agent, or Firm*—Oblon, Spivak, McClelland, Maier & Neustadt, L.L.P.

(57) ABSTRACT

An elevator operation controller can land the elevator cage of an elevator at a predetermined floor by giving a command to the elevator without using a special key or a special portable terminal. An elevator operation controller 10 includes a receiving unit 11 specified by a proper telephone number and capable of receiving a speech from the elevator user through a public communication line, a speech recognition unit 12 for recognizing the speech of the elevator user received by the receiving unit 11, a command processing unit 13 for converting a command given by the elevator user and recognized by speech recognition made by the speech recognition unit 12 into an elevator operating signal, and an operation control unit 14 for controlling the operation of the elevator on the basis of the operating signal provided by the command processing unit 13.

6 Claims, 9 Drawing Sheets

FOREIGN PATENT DOCUMENTS

| | | |
|---|---|---|
| JP | 06-255911 | 9/1994 |
| JP | 7 321936 | 12/1995 |
| JP | 9 40313 | 2/1997 |
| JP | 2003-104633 | 4/2003 |
| JP | 2003 212446 | 7/2003 |
| JP | 2003 341945 | 12/2003 |

* cited by examiner

ELEVATOR OPERATING APPARATUS

BACKGROUND OF THE INVENTION

1. Field of the Invention

The present invention relates to an elevator operation controller for controlling the operation of an elevator and, more specifically, to techniques for automatically landing an elevator cage to the floor of an elevator hall of a building before an elevator user arrives at the elevator hall, and for automatically registering a destination call to a destination floor, by sending a command with telephone through public communication lines or private communication lines.

2. Description of the Related Art

Many techniques have been proposed to reduce a waiting time for which the elevator user is obliged to wait for an elevator cage at a floor of an elevator hall, by landing the elevator at the floor before the elevator user arrives at the elevator hall. A technique disclosed in JP 2002-129793 A, for example, lands the elevator cage automatically at the entrance floor of a building in response to an unlock signal provided when the lock of an entrance door is unlocked by a key, and registers a destination call for the elevator cage to a destination floor previously registered corresponding to the key used to unlock the entrance door.

Mobile communication techniques have developed in recent years and many elevator operating methods that operate an elevator by a signal transmitted by a portable terminal such as mobile phone have been proposed (Refer to JP 1993-278926 A).

A destination call registering device proposed in, for example, JP 1994-255911 registers a destination call based on a speech recognition technique in response to the pronunciation of a destination floor.

However, there is a possibility that the elevator user cannot use the elevator if the elevator user loses the key, when the elevator is controlled by a system that lands the elevator cage of an elevator automatically at a entrance floor in response to an unlock signal provided when the lock of an entrance door is unlocked by the key and registers a destination call for the elevator cage to a destination floor preliminary registered corresponding to the key.

Most elevators operated by an operating system using digital signals provided by the portable terminal require specially designed portable terminals.

A destination call registration system that uses a speech recognition device and registers a destination call in response to the pronunciation of the floor number of a destination floor needs a speech recognizing device installed in an elevator hall, and hence the design of the elevator hall need to be planned so.

SUMMARY OF THE INVENTION

Accordingly, it is an object of the present invention to solve the problems in the related art and to provide an elevator operation controller for controlling the operation of an elevator, capable of automatically landing the elevator cage of an elevator to an elevator hall before the elevator user arrives at the elevator hall, and of automatically registering a destination call to a destination floor by sending a command to the elevator without using any special key or a special portable terminal.

An elevator operation controller in a first aspect of the present invention capable of controlling the operation of an elevator in response to a command given thereto by an elevator user staying outside a building through a public communication line includes: a receiving unit having a proper telephone number and capable of receiving a speech from the elevator user through a public communication line; a speech recognition unit for recognizing the speech of the elevator user received by the receiving unit; a command processing unit for converting a command given by the elevator user and recognized by speech recognition made by the speech recognition unit into an elevator operating signal; and an operation control unit for controlling the operation of the elevator on the basis of the operating signal provided by the command processing unit.

When the elevator is controlled by the elevator operation controller in the first aspect of the present invention, the elevator user can give a command to the elevator by communication through a public communication line without using any special key or a special portable terminal. Public communication lines include, in addition to general telephone lines, mobile telephones, and Internet telephones. The speech recognition includes not only the recognition of language such as "third floor" pronounced by the elevator user, but also the recognition of a mechanical sound of a specific frequency generated by a portable terminals when the numeric key, for example "3" of the portable terminal, is pushed.

According to a second aspect of the present invention, in the elevator operation controller in the first aspect of the present invention, the command processing unit sends operating signals representing a command requesting landing of the elevator cage of the elevator at an entrance floor of the building and a command requesting destination call registration when the speech recognition unit recognizes the speech pronounced by the elevator user to specify a destination floor.

The elevator operation controller according to the second aspect of the present invention can land the elevator cage at the entrance floor before the elevator user arrives at the entrance floor on the basis of the command given thereto through the public communication line by the elevator user staying outside the building and can start moving the elevator cage toward the destination floor immediately after the elevator user has get into the elevator cage.

According to a third aspect of the present invention, the elevator operation controller in the first aspect of the present invention further includes an authentication unit that determines whether or not the command given by the elevator user is acceptable, wherein the authentication unit collates a personal identification number pronounced by the elevator user and processed by speech recognition by the speech recognition unit with a previously stored personal identification number and permits the acceptance of the command given by the elevator user only when the recognized personal identification number coincides with the stored personal identification number.

The elevator operation controller in the third aspect of the present invention enables only the elevator user knowing the previously registered personal identification number to use the elevator preferentially by sending a command to the elevator from outside the building.

According to a fourth aspect of the present invention, the elevator operation controller in the first aspect of the present invention further includes an authentication unit that determines whether or not the command given by the elevator user is acceptable, wherein the authentication unit collates a sender's telephone number assigned to a telephone used by the elevator user with a previously registered telephone number and permits the acceptance of the command given by the elevator user only when the sender's telephone number coincides with the previously registered telephone number.

The elevator operation controller in the fourth aspect of the present invention enables only the elevator user using the telephone having the registered telephone number to use the elevator preferentially by sending a command to the elevator from outside the building.

According to a fifth aspect of the present invention, the elevator operation controller in the first aspect of the present invention further includes an authentication unit that determines whether or not the command given by the elevator user is acceptable, wherein the authentication unit analyzes the voice print of user's voice through voice print analysis, collates the user's voice print with a previously stored voice print and permits the acceptance of the command given by the elevator user only when the user's voice print coincides with the stored voice print.

The elevator operation controller in the fifth aspect of the present invention enables only the elevator user having the voice print coinciding with the previously registered voice print to use the elevator preferentially by sending a command to the elevator from outside the building.

According to a sixth aspect of the present invention, in the elevator operation controller in the first aspect of the present invention, when the speech recognition unit recognizes a telephone number of a telephone used by the elevator user for communication and pronounced by the user through the speech recognition, the command processing unit recognizes a floor of the building at which the telephone used by the elevator user is located on the basis of a telephone number assigned to the telephone and previously registered information, and the command processing unit sends an operating signal corresponding to a command requesting of landing the elevator cage at the recognized floor to the operation control unit.

The elevator operation controller in the sixth aspect of the present invention can know a floor of the building on which the elevator user stays from the telephone number assigned to the telephone used by the elevator user for communication and can make the elevator cage start moving toward the floor on which the elevator user stays upon the reception of a speech by the receiving unit through a private communication line. Therefore, waiting time for which the elevator user is obliged to wait before getting into the elevator cage can be further shortened.

According to a seventh aspect of the present invention, in the elevator operation controller in the first aspect of the present invention, when the speech recognition unit recognizes a telephone number of a telephone used by an elevator user for communication and pronounced by the elevator user through the speech recognition, the command processing unit recognizes a destination floor of the building to which the elevator user intends to go on the basis of the telephone number and previously registered information, and the command processing unit sends an operating signal for registering a destination call for the recognized destination floor to the operation control unit.

The elevator operation controller in the seventh aspect of the present invention recognizes the telephone number assigned to the telephone being used by the elevator user, can find out a destination floor to which the elevator user intends to go on the basis of the previously registered information and can immediately register a destination call for the destination floor. Thus the elevator user can use the elevator without giving a command specifying a destination floor when the elevator user intends to go to the previously registered destination floor.

According to an eighth aspect of the present invention, the elevator operation controller in the first aspect of the present invention further includes a communication line distinguishing unit for distinguishing a communication line through which a speech of the elevator user is received by the receiving unit, wherein the receiving unit is capable of receiving either of a speech of the elevator user staying outside the building through a public communication line and a speech of the elevator user staying inside the building through a private communication line, and the command processing unit recognizes a floor of the building on which a telephone used by the elevator user is installed on the basis of a telephone number assigned to the telephone used by the elevator user when the receiving unit decides that the speech has been received through a private communication line, and the command processing unit sends an operating signal representing a command requesting landing of the elevator cage at the recognized floor to the operation control unit.

The elevator operation controller in the eighth aspect of the present invention enables the elevator user staying inside the building to send a command to the elevator through a private communication line. The floor of the building on which the elevator user is staying can be known through the recognition of the telephone number assigned to the telephone being used for communication by the elevator user and the elevator cage can be made to start moving toward the floor upon the reception of the speech through a private communication line by the receiving unit. Therefore, waiting time for which the elevator user is obliged to wait before getting into the elevator cage can be further curtailed.

According to a ninth aspect of the present invention, in the elevator operation controller in the first aspect of the present invention further includes a line distinguishing unit for distinguishing a communication line through which the speech of the elevator user is received by the receiving unit, wherein the receiving unit is capable of receiving either of a speech of the elevator user staying outside the building through a public communication line and a speech of the elevator user staying inside the building through a private communication line, the command processing unit recognizes a destination floor of the building to which the elevator user intends to go on the basis of a telephone number assigned to the telephone used by the elevator user and previously registered information, when the receiving unit decides that the speech has been received through a public communication line and the command processing unit sends an operating signal representing a command requesting destination call registration for registering the destination floor to the operation control unit.

The elevator operation controller in the ninth aspect of the present invention recognizes the telephone number assigned to the telephone being used for communication by the elevator user when a speech of the elevator user staying outside the building is received through a public communication line, determines a destination floor to which the elevator user intends to go on the basis of previously registered information and can immediately register a destination call. Thus the elevator user can use the elevator without giving a command specifying a destination floor when the elevator user intends to go to the previously registered destination floor.

The elevator operation controller according to the present invention enables the elevator user to land the elevator cage at the entrance floor before the elevator user arrives at the entrance hall by giving a command to the elevator without using any special key or a special portable terminal, and the automatic registration of a call for the destination floor.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
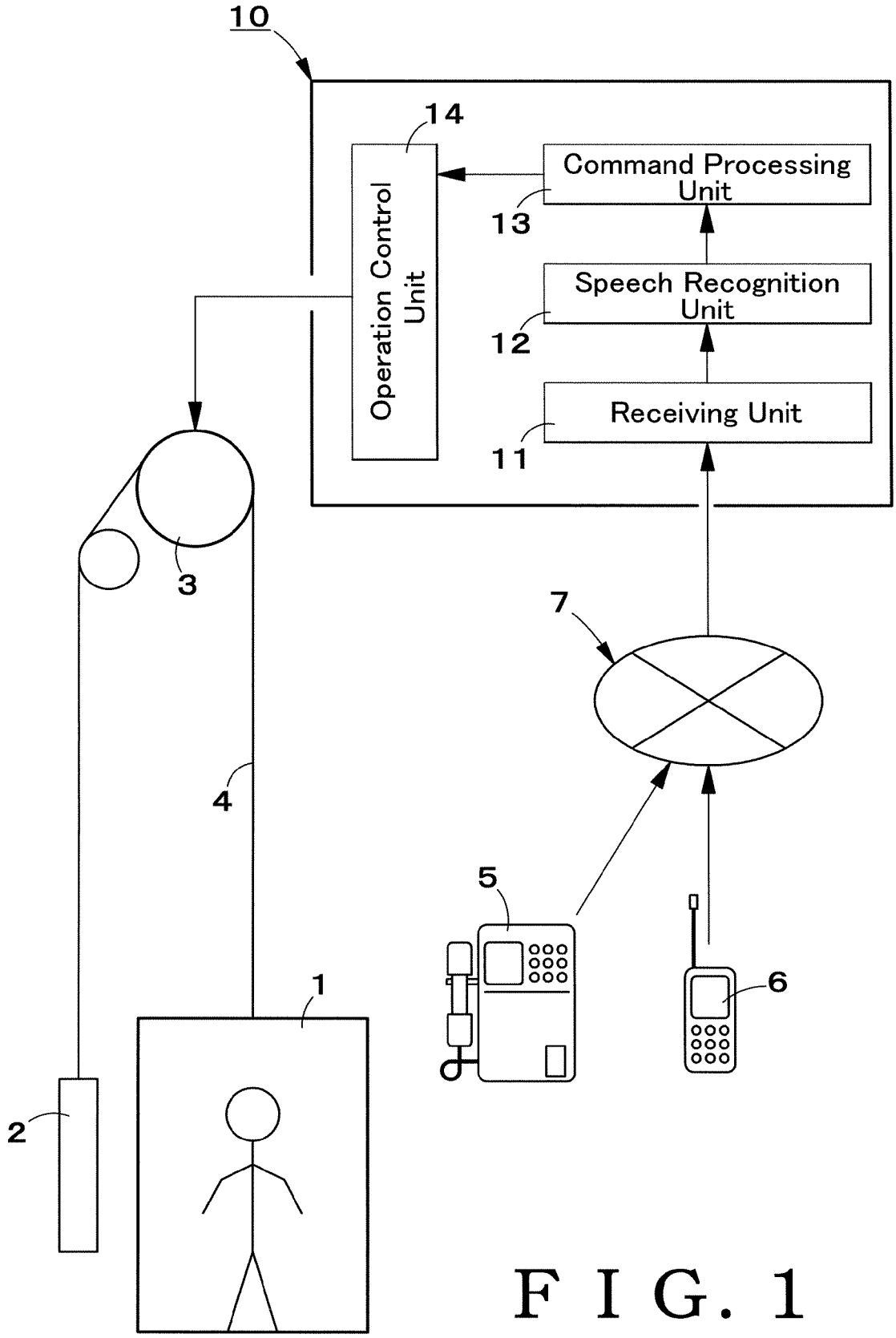
FIG. 1 is a view typically showing the construction of an elevator operation controller in a first embodiment according to the present invention.

Elevator operation controllers in preferred embodiments according to the present invention will be described with reference to FIGS. 1 and 9. In the following description, like parts are designated by the same reference characters and the duplicate description thereof will be omitted.

First Embodiment

Referring to FIG. 1, an elevator cage 1 and a counterweight 2 are suspended like well buckets by a main rope 4 wound round a driving sheave 3. The elevator cage 1 and the counterweight 2 move vertically in opposite directions, respectively. An elevator operation controller 10 controls the operation of a drive motor, not shown, for rotating the driving sheave 3.

The elevator operation controller 10 includes a receiving unit 11. A telephone 5, such as a public telephone or an extension telephone on a desk, or a portable telephone 6 can be connected to the receiving unit 11 by a public communication line 7. A specific telephone number is assigned to the receiving unit 11. An elevator user staying outside a building in which the elevator is installed can make a telephone call to the receiving unit 11 by the public telephone 5 or the portable telephone 6 and send a message to the receiving unit 11. Upon the completion of an acoustic message sent out by the elevator user and received by the receiving unit 11, a speech recognition unit 12 analyzes a command pronounced by the elevator user by speech recognition. A command processing unit 13 converts the command analyzed by speech recognition into an operating signal for operating the elevator and sends the operating signal to an operation control unit 14. The operation control unit 14 operates the drive motor on the basis of the operating signal given thereto to land and hold the elevator cage 1 at the floor at an entrance hall or a specified floor. Moreover, the operation control unit 14 can registers a destination call for a destination floor beforehand to make the elevator start moving toward the destination floor immediately after the door of the elevator has been closed.

Figure 2:
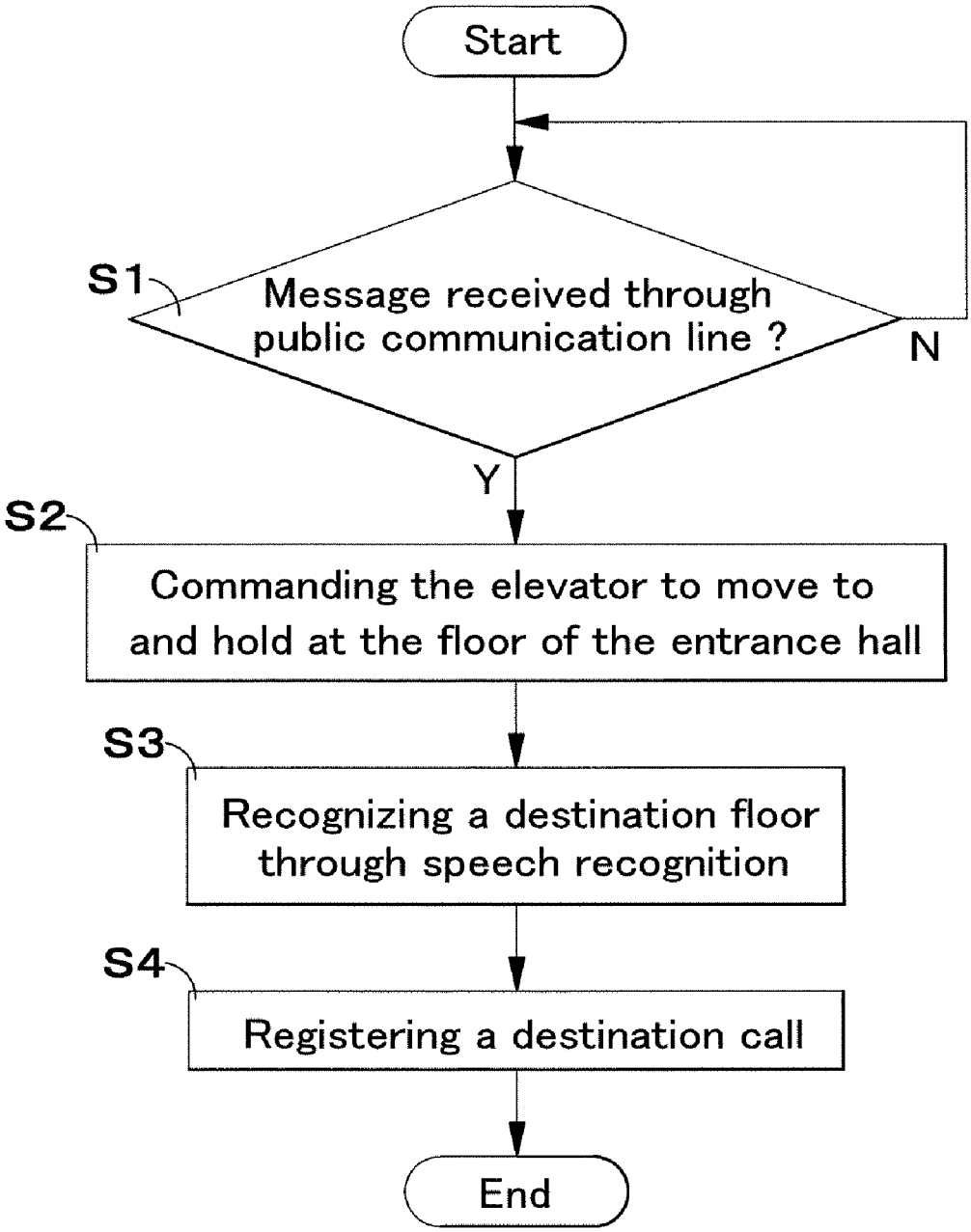
FIG. 2 is a flow chart showing operations of the elevator operation controller shown in FIG. 1.

The elevator operation controller 10 carries out a procedure shown in FIG. 2. When it is decided in step S1 that a message sent out by the elevator user staying outside the building by operating the public telephone 5 or portable telephone 6 has been received through a public communication line 7, the elevator cage 1 is moved to and held at the floor of the entrance hall in step S2. In step S3, a destination floor is recognized through the speech recognition of a speech pronounced by the elevator user. In step S4, a destination call is registered.

A private secretary to a VIP can separate the control of a specific elevator from a group control system by sending a command to the elevator operation controller 10 from outside the building by using the portable telephone 6. Thus, the elevator cage 1 of the specific elevator can be landed and held at the floor at the entrance hall before the VIP arrives at the elevator hall.

Since the destination call has been registered before the VIP gets into the elevator cage 1, the elevator cage 1 starts moving vertically immediately after the VIP has gotten into the elevator cage 1. Thus the VIP can smoothly use the elevator.

Second Embodiment

Figure 3:
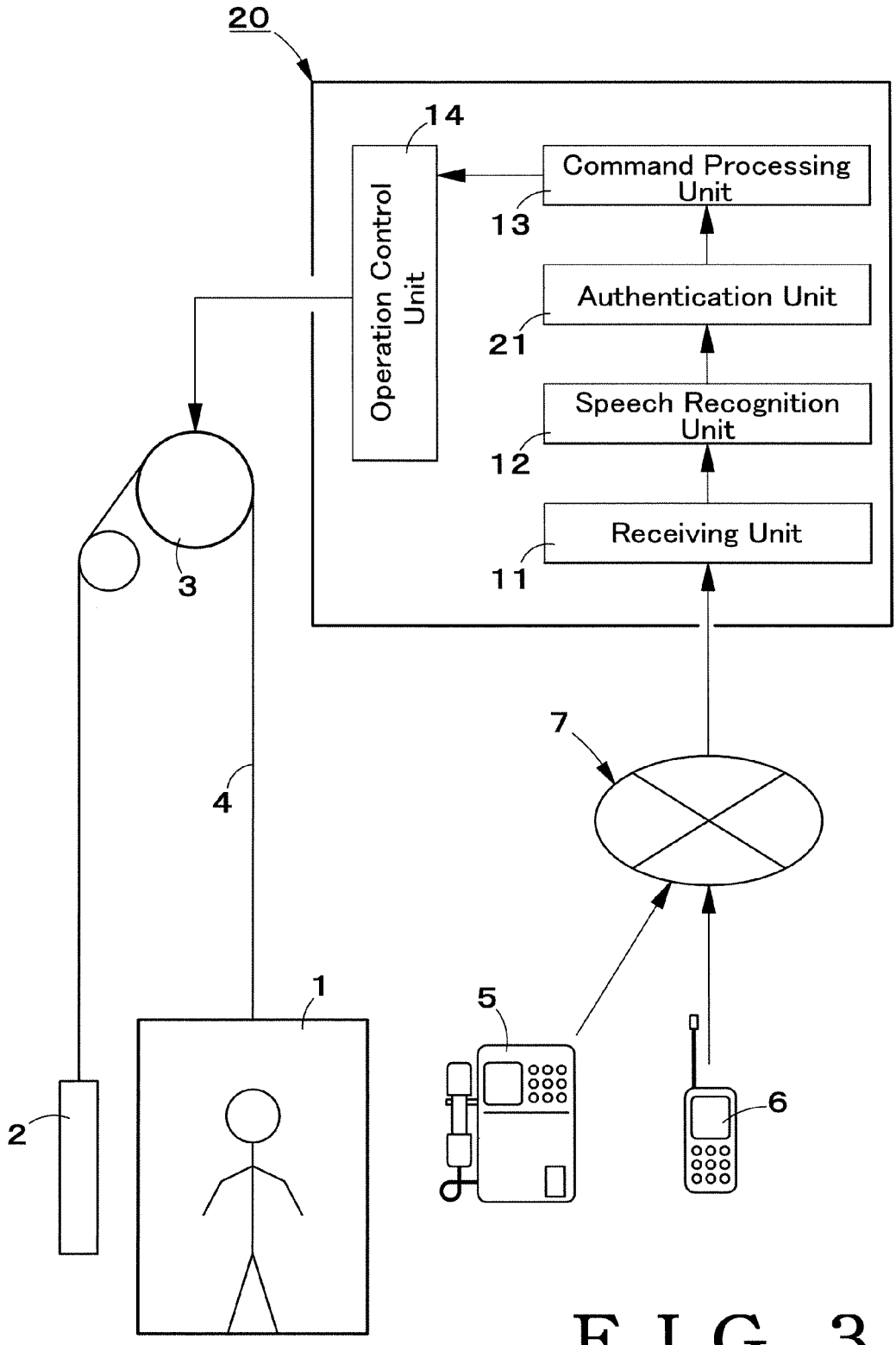
FIG. 3 is a view typically showing the construction of an elevator operation controller in a second embodiment according to the present invention.

An elevator operation controller 20 in a second embodiment according to the present invention shown in FIG. 3 is built by adding an authentication unit 21 to the elevator operation controller 10 shown in FIG. 1. The authentication unit 21 examines a speech received through a public communication line 7 to see whether or not the speech is sent by a registered, authorized user of an elevator and to decide whether or not the command is acceptable. More concretely, the command processed by speech recognition by the speech recognition unit 12 is transmitted to the command processing unit 13 when the command given by the elevator user is acceptable, and the command processed by speech recognition by the speech recognition unit 12 is not transmitted to the command processing unit 13 when the command given by the elevator user is rejectable.

Figure 4:
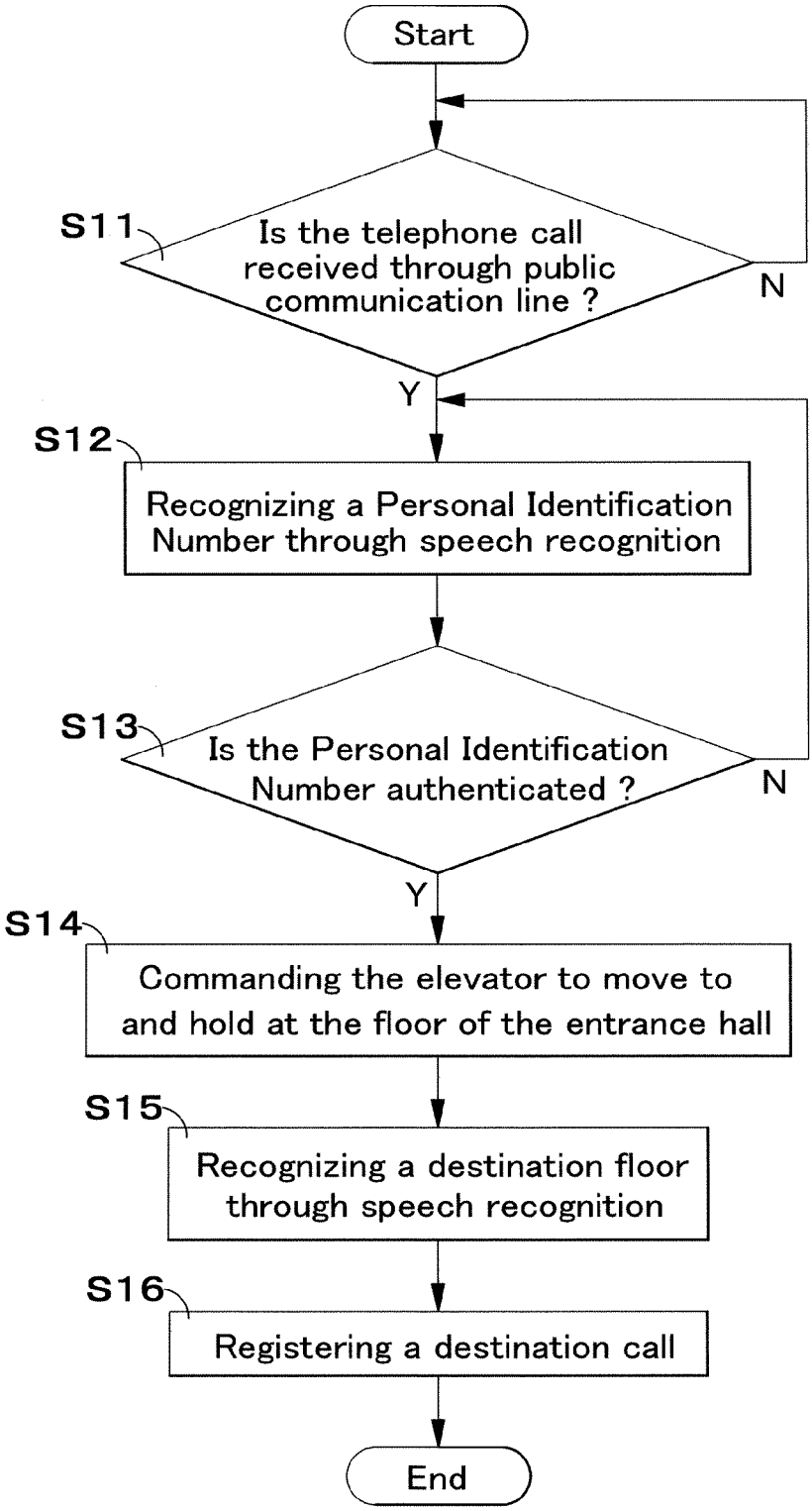
FIG. 4 is a flow chart showing operations of the elevator operation controller shown in FIG. 3.

The elevator operation controller 20 provided with the authentication unit 21 carries out a procedure shown in FIG. 4. When it is decided in step S11 that a message sent out by the elevator user staying outside the building by operating the portable telephone 6 has been received through a public communication line 7, the elevator user is prompted to pronounce a personal identification number and the pronounced personal identification number is subjected to speech recognition in step S12. In step S13, the authentication unit 21 collates the personal identification number processed by speech recognition with a registered personal identification number and decides that the user's command is acceptable when the personal identification number coincides with the registered personal identification number. When the command is decided to be acceptable, the elevator operation controller 20 moves the elevator cage 1 to and hold at the floor at the entrance hall in step S14. Then, the elevator operation controller 20 prompts the elevator user to pronounce the floor number of a destination floor and recognizes the floor number of the destination floor through speech recognition in step S15 and registers a destination call in step S16.

Figure 5:
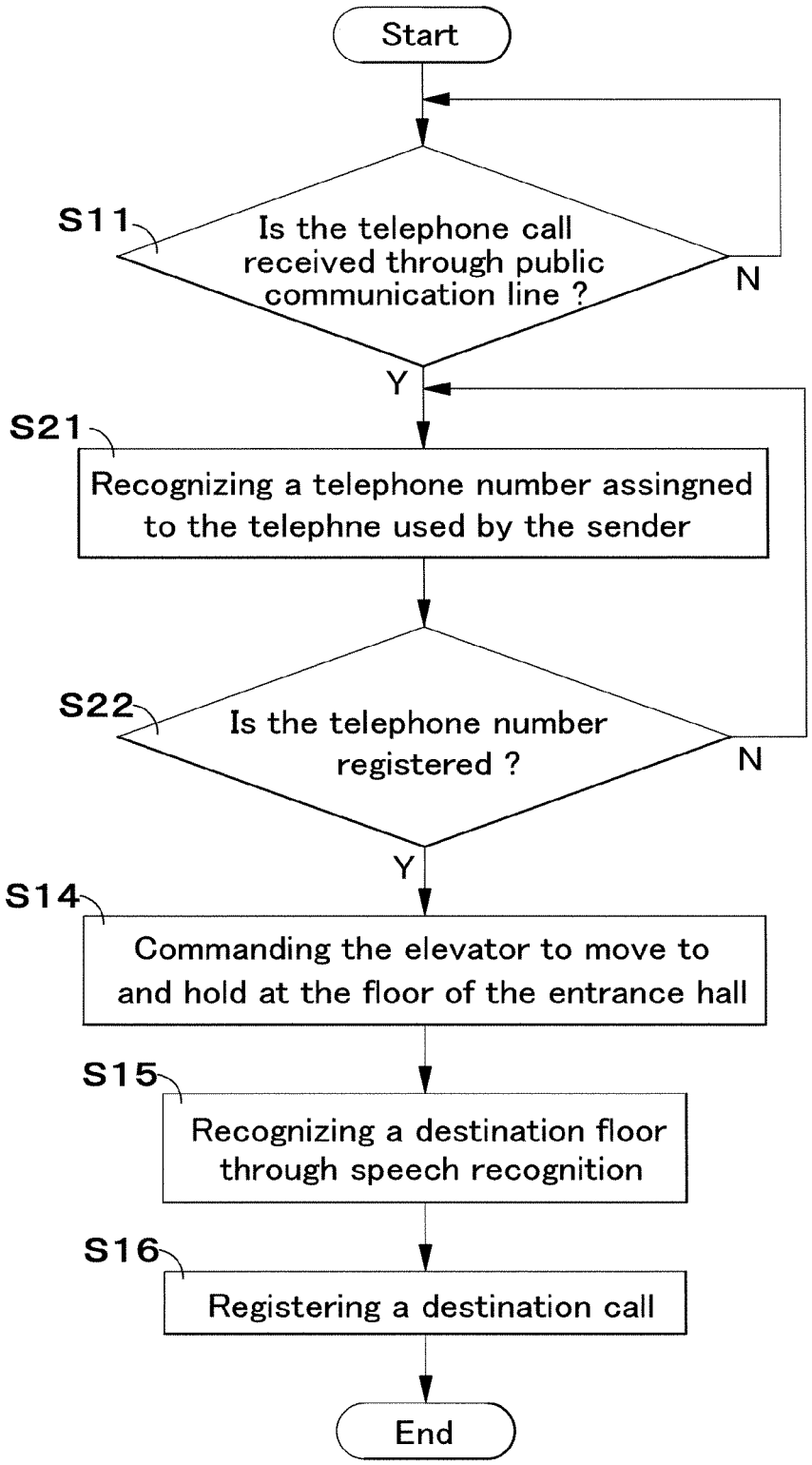
FIG. 5 is a flow chart showing operations of the elevator operation controller shown in FIG. 3.

In a procedure shown in FIG. 5, the authentication unit 21 recognizes a telephone number assigned to the user's portable telephone 6 in step S21, collates the recognized telephone number with a previously registered telephone number and decides that the command given by the elevator user is acceptable only when the recognized and the registered telephone number coincide with each other in step S22.

Figure 6:
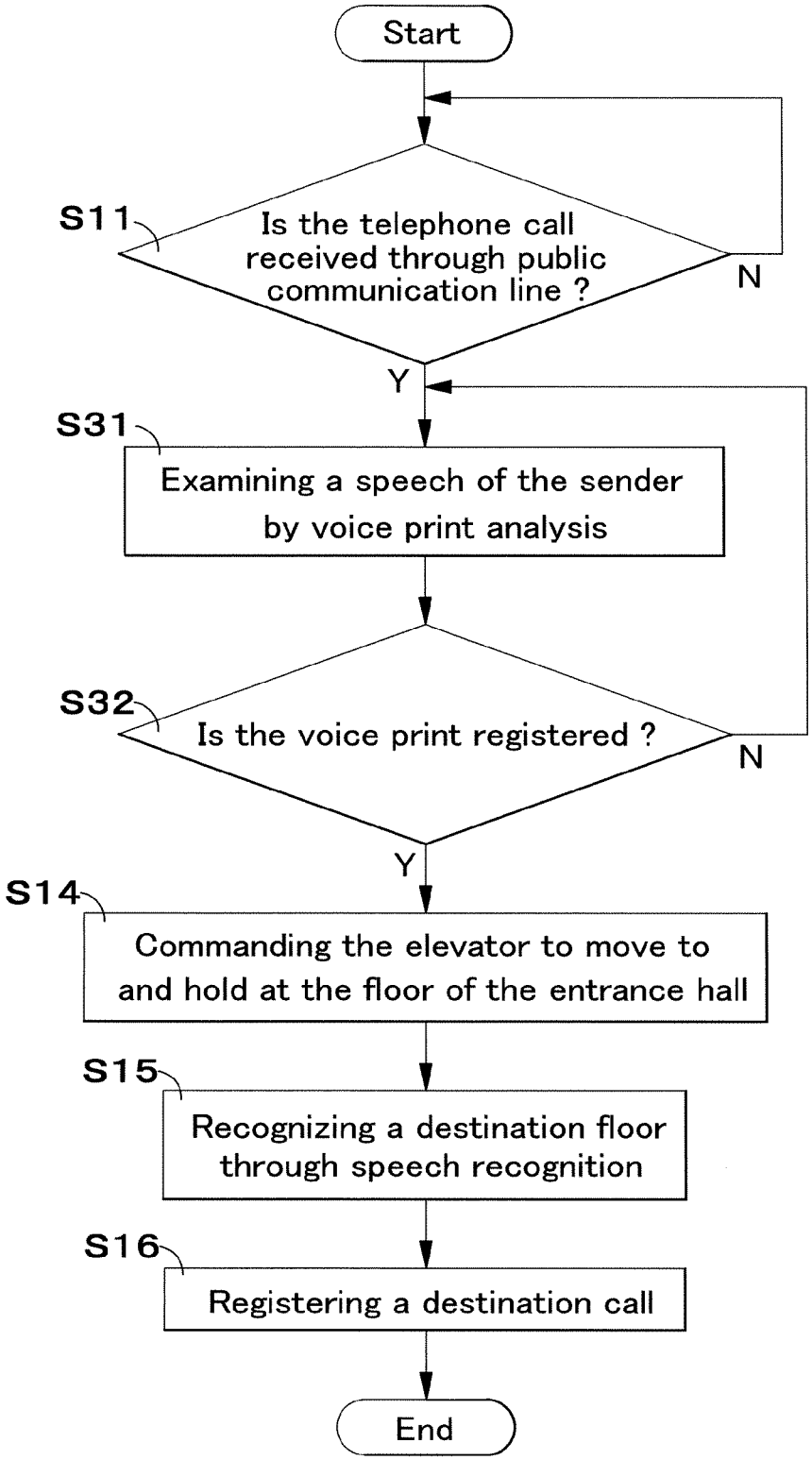
FIG. 6 is a flow chart showing operations of the elevator operation controller shown in FIG. 3.

In a procedure shown in FIG. 6, the authentication unit 21 examines a speech pronounced by the elevator user by voice print analysis in step S31, collates a voice print obtained by voice analysis with a previously registered voice print and decides that the command given by the elevator user is acceptable only when the voice print obtained by voice print analysis and the registered voice print coincide with each other in step S32.

The elevator operation controller 20 in the second embodiment permits only the registered users to give a command to the elevator. Consequently, the elevator can ensure high security to the users of the elevator and can prevent the dishonest use of the elevator by unauthorized persons. The elevator can limit the use of the elevator by general users when a command is give to the elevator by a special user to enable VIPs and such to use the elevator preferentially.

Third Embodiment

Figure 7:
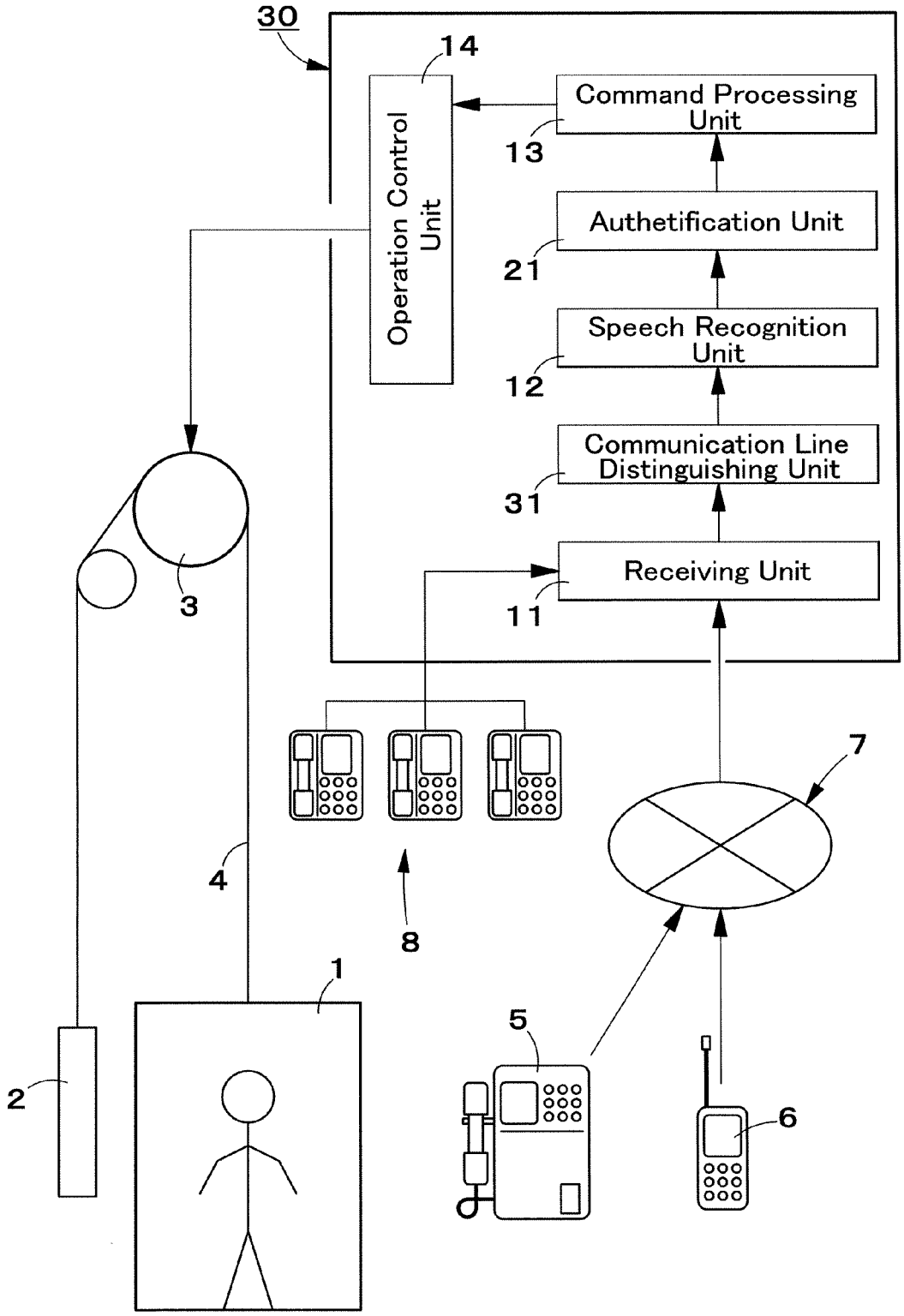
FIG. 7 is a view typically showing the construction of an elevator operation controller in a third embodiment according to the present invention.

An elevator operation controller 30 in a third embodiment according to the present invention shown in FIG. 7 differs from the elevator operation controller 20 shown in FIG. 3 in that the receiving unit 11 is capable of receiving a telephone call through a private communication line 8 and is additionally provided with a communication line distinguishing unit 31.

The receiving unit 11 receives either of a speech sent by the elevator user by operating a portable telephone 6 through a public communication line and a speech sent by the elevator user by operating a telephone through a private communication line 8. The line distinguishing unit 13 decides whether the receiving unit 11 received the speech through a public communication line 7 or a private communication line. A command processing unit 13 sends an operating signal indicting either of the public communication line and the private communication line through which the receiving unit 11 received the speech to an operation control unit 14.

Figure 8:
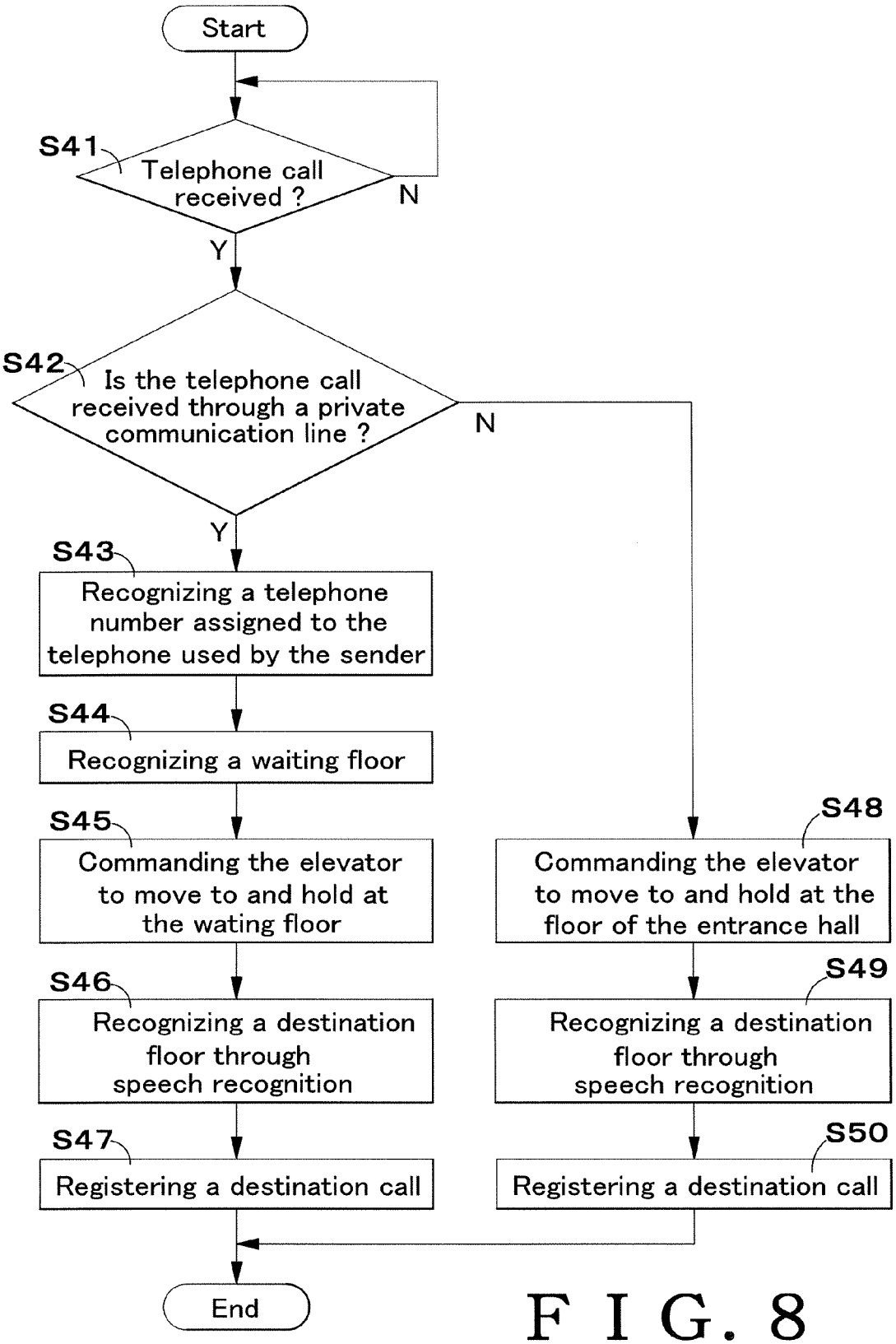
FIG. 8 is a flow chart showing operations of the elevator operation controller shown in FIG. 7.

More concretely, the elevator operation controller 30 carries out a procedure shown in FIG. 8. When the reception of a speech by the receiving unit 11 is recognized in step S41, the communication line distinguishing unit 31 decides a line through which the speech is received in step S42. When it is decided that the speech is received through the private communication line 8, a telephone number assigned to a telephone being used is known in step S43. Then, in step S44, a waiting floor i.e., a floor in the building on which the elevator user using the telephone stays is recognized. Then, in step S45, the elevator cage 1 is commanded to move to and held at the waiting floor. In step S46, the elevator user is prompted to pronounce the floor number of a destination floor and the destination floor is recognized by speech recognition. In step S47, a destination call is registered.

When it is decided that the speech is received through the public communication line 7, the elevator operation controller 30 lands and holds the elevator cage 1 at the floor of the entrance floor in step S48. In step S49, the elevator user is prompted to pronounce the floor number of a destination floor, the pronounced floor number is recognized by speech recognition in step S49. Then, a destination call is registered in step S50.

The elevator operation controller 30 in the third embodiment can make the elevator cage 1 start moving toward a floor on which the elevator user is staying immediately after the reception of a speech through the private communication line 8 by the receiving unit 11, and can land and hold the elevator cage 1 at the floor on which the elevator user is staying. Thus, waiting time for which the elevator user is obliged to wait before using the elevator can be shortened.

Figure 9:
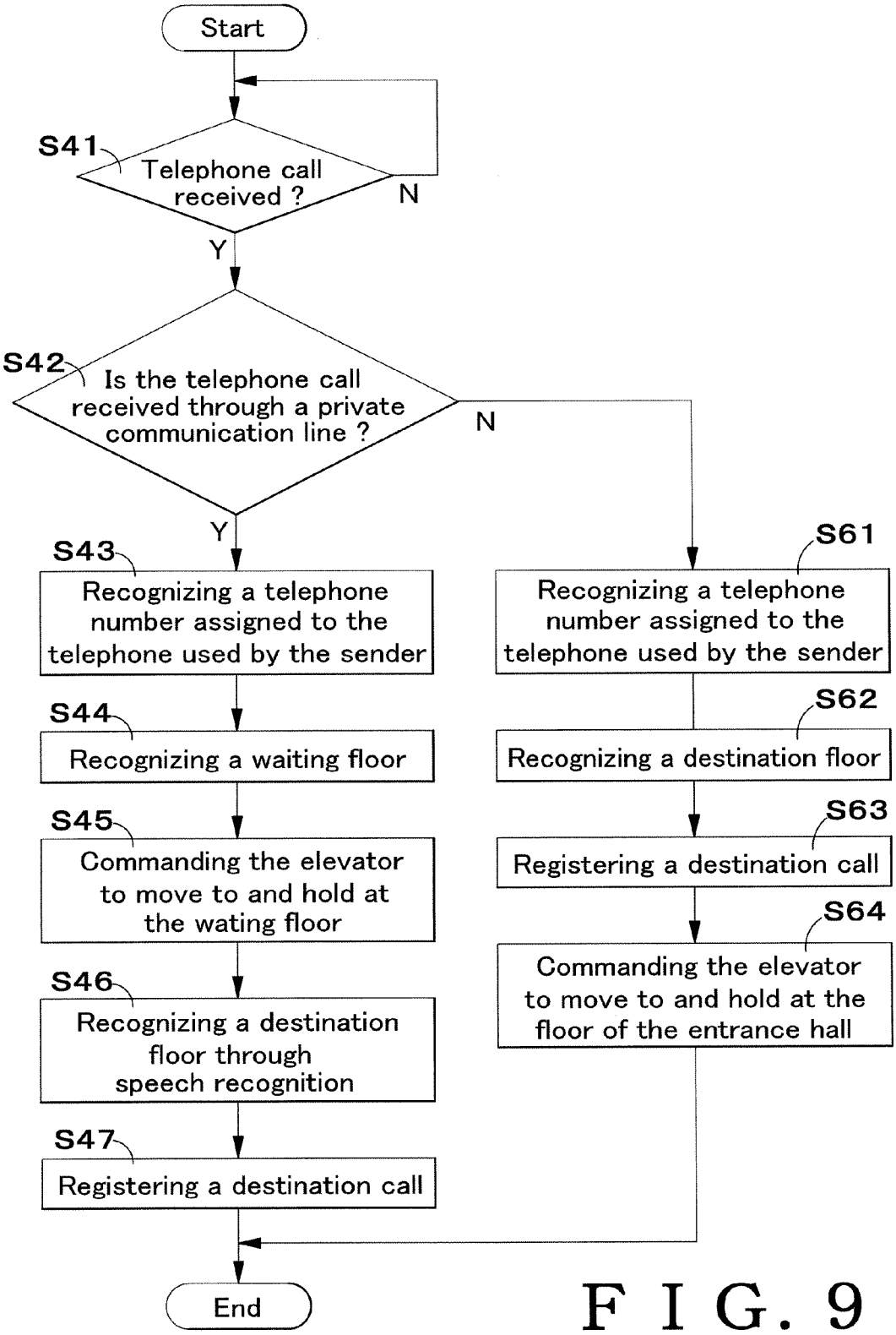
FIG. 9 is a flow chart showing operations of the elevator operation controller shown in FIG. 7.

Further, the elevator operation controller 30 can carry out a procedure shown in FIG. 9. When it is decided that a speech is received through the public communication line 7 in step S42, a telephone number assigned to the telephone used for sending speech is recognized in step S61. Then, in step S62, a destination floor to which the elevator user intends to go is recognized on the basis of information about the relation between a previously registered telephone number and a destination floor, and a destination call can be immediately registered. Thus, the elevator user can use the elevator to go to the registered destination floor without giving any command requesting moving the elevator cage 1 to the destination floor.

Although the elevator operation controllers in the preferred embodiments have been described, the present invention is not limited in its practical application to those specifically described herein and various changes may be made therein. For example, although the third embodiment uses the sender's telephone number obtained from the telephone, the telephone number assigned to the telephone used by the elevator user for communication can be recognized by processing the telephone number pronounced by the elevator user by speech recognition.

Although the foregoing embodiments receive a command from the elevator user through the speech recognition of language pronounced or talked by the elevator user, for example, a command can be received from the elevator user through the speech recognition of machine sound which is sent out when the alphanumeric keys for 0 to 9, *, # and such of the telephone are pushed.

The invention claimed is:

1. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal;

an operation control unit configured to control the operation of the elevator on the basis of the operating signal provided by the command processing unit; and an authentication unit configured to determine whether or not the command given by the elevator user is acceptable, wherein the authentication unit collates a sender's telephone number assigned to a telephone used by the elevator user with a previously registered telephone number, and permits the acceptance of the command given by the elevator user only when the sender's telephone number coincides with the previously registered telephone number.

2. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal;

an operation control unit configured to control the operation of the elevator on the basis of the operating signal provided by the command processing unit; and an authentication unit configured to determine whether or not the command given by the elevator user is acceptable, wherein the authentication unit analyzes the voice print of user's voice through voice print analysis, collates the user's voice print and a previously stored voice print, and permits the acceptance of the command given by the elevator user only when the user's voice print coincides with the stored voice print.

3. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal; and an operation control unit configured to control the operation of the elevator on the basis of the operating signal provided by the command processing unit, wherein when the speech recognition unit recognizes a telephone number of a telephone used by the elevator user for communication and pronounced by the elevator user through the speech recognition, the command processing unit recognizes a floor of the building at which the telephone used by the elevator user is located on the basis of a telephone number assigned to the telephone and previously registered information, and sends an operating signal corresponding to a command requesting of landing the elevator cage at the recognized floor to the operation control unit.

4. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal; and an operation control unit configured to control the operation of the elevator on the basis of the operating signal provided by the command processing unit, wherein when the speech recognition unit recognizes a telephone number of a telephone used by an elevator user for communication and pronounced by the elevator user through the speech recognition, the command processing unit recognizes a destination floor of the building to which the elevator user intends to go on the basis of the telephone number and previously registered information, and the command processing unit sends an operating signal for registering a destination call for the recognized destination floor to the operation control unit.

5. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal;

an operation control unit configured to control the operation of the elevator on the basis of the operating signal provided by the command processing unit; and a line distinguishing unit configured to distinguish a line through which a speech of the elevator user is received by the receiving unit, wherein the receiving unit is configured to receive either of a speech of the elevator user staying outside the building through a public communication line and a speech of the elevator user staying inside the building through a private communication line, and the command processing unit recognizes a floor of the building on which a telephone used by the elevator user is installed on the basis of a telephone number assigned to the telephone used by the elevator user when the receiving unit decides that the speech has been received through a private communication line, and the command processing unit sends an operating signal representing a command requesting landing of the elevator cage at the recognized floor to the operation control unit.

6. An elevator operation controller that controls an operation of an elevator in response to a command given by an elevator user staying outside a building through a public communication line, said elevator operation controller comprising:

a receiving unit configured to receive speech from the elevator user through a public communication line;

a speech recognition unit configured to recognize the speech of the elevator user received by the receiving unit;

a command processing unit configured to convert a command given by the elevator user and recognized by speech recognition made by the speech recognition unit into an elevator operating signal;

an operation control unit configured to control the operation of the elevator on the basis of the operating signal provided by the command processing unit; and a communication line distinguishing unit configured to distinguish a communication line through which a speech of the elevator user is received by the receiving unit, wherein the receiving unit is configured to receive either of a speech of the elevator user staying outside the building through a public communication line and a speech of the elevator user staying inside the building through a private communication line, the command processing unit recognizes a destination floor of the building to which the elevator user intends to go on the basis of a telephone number assigned to the telephone used by the elevator user and previously registered information, when the receiving unit decides that the speech has been received through a public communication line and the command processing unit sends an operating signal representing a command requesting destination call registration for registering the destination floor to the operation control unit.

* * * * *